US007322857B2

(12) United States Patent
Chen

(10) Patent No.: US 7,322,857 B2
(45) Date of Patent: Jan. 29, 2008

(54) ELECTRIC POWER CONNECTOR ADAPTING STRUCTURE

(75) Inventor: Michael Chen, Taipei Hsien (TW)

(73) Assignee: Topower Computer Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 11/395,213

(22) Filed: Apr. 3, 2006

(65) Prior Publication Data

US 2007/0232106 A1 Oct. 4, 2007

(51) Int. Cl.
*H01R 4/60* (2006.01)

(52) U.S. Cl. ..... 439/638; 439/623; 439/912

(58) Field of Classification Search ..... 439/210, 439/224, 721, 404, 638, 623, 912
See application file for complete search history.

(56) References Cited

U.S. PATENT DOCUMENTS 4,429,943 A * 2/1984 Inoue ..... 439/721
5,295,858 A * 3/1994 Kasai et al. ..... 439/404
6,394,849 B2 * 5/2002 Kasai ..... 439/655
6,635,824 B1 * 10/2003 Oka ..... 174/72 C
6,790,071 B2 * 9/2004 Uezono ..... 439/404
6,923,671 B2 * 8/2005 Uezono ..... 439/404
6,994,585 B2 * 2/2006 Benoit et al. ..... 439/535

FOREIGN PATENT DOCUMENTS

TW M253980 U 12/2004

* cited by examiner

*Primary Examiner*—Neil Abrams
*Assistant Examiner*—PhuongChi Nguyen
(74) *Attorney, Agent, or Firm*—Birch, Stewart, Kolasch & Birch, LLP.

(57) ABSTRACT

An electric power connector adapting structure includes a connector connected to an electric power cable of a power supply and adapted to an adapting cable for supplying electric power to a port, and the connector installs an electric power terminal therein. The invention includes an electric connecting portion corresponding to a vertical side of an open side of the electric power terminal for connecting an adapting cable, so that the port is electrically coupled to the electric power terminal with an equivalent electric potential, and the connector is connected to a power output port of a power supply for the use of an adapter. The present invention connects an adapting cable to a lateral side of the connector to achieve an easy installation and effectively avoid using excessive cable materials or having a poor cable management.

6 Claims, 7 Drawing Sheets

ELECTRIC POWER CONNECTOR ADAPTING STRUCTURE

BACKGROUND OF THE INVENTION

The present invention relates to an electric power connector, and more particularly to an electric power connector adapting structure that has an adapting cable connected to a lateral side of the electric power connector.

BRIEF DISCUSSION OF THE RELATED ART

Since computers are very popular, they have become an indispensable electric appliance or tool for household users or companies, and all components such as a central processing unit, a motherboard, a hard disk drive and an optical drive of a computer require electric power supplied by a power supply. Referring to R.O.C. Pat. Publication No. M253980 entitled "Power output connector of a power supply" for a traditional power supply, the traditional electric power connector of the traditional power supply comes with a 20-pin port or a 24-pin port on a motherboard to meet the requirements of electronic peripherals and devices with different specifications, and the pin number of hard disk drives and floppy disk drives include a large 4-pin port or a small 4-pin port for connecting an adapting cable to an electric power connector with a power cable. The adapting cable and the power cable are installed on the same side of the electric power connector. However, the motherboard has already installed many other cables and wires, and such electric power connector adapting structure may interfere with the original wires and cables installed on the motherboard, and thus making the cable management of the motherboard more difficult. Furthermore, the motherboard usually comes with many ports, but the prior art adapting cable installed on the same side of the power cable of the electric power connector may make their installation very difficult, if not impossible. Therefore, if the adapting cable of the electric power connector is connected perpendicularly to a lateral side of the electric power connector instead of being connected on the same side of the power cable, then the cables and wires on the motherboard will not interfere with the adapting cable or cause a poor cable management.

Further, for example, a 20-pin or 24-pin electric power connector connected to a motherboard includes an electric power terminal for a normal electric power supply (such as +5V STB), and the electric power will be supplied to electronic components of a computer even when the computer is turned off. If an adapter is connected to the +5V power terminal for the use of the power, then an additional adapter can be used for other specifications (such as the USB specification), while maintaining the original design for supplying electric power to the motherboard from the 20-pin or 24-pin connector. Even if the computer is turned off, an adapter with the adapting cable can be used as a power source of a port for lighting up a small lamp or charging the battery of a mobile phone, and thus fully utilizing the electric power supplied from the power terminal, when the computer is turned off. Such arrangement can save power to meet the requirements of environmental protection, and the diversified functions of the connector also can bring convenience to users.

SUMMARY OF THE INVENTION

In view of the foregoing shortcomings of the prior art connector adapting structure, the present invention improves the power management of the adapting cable of an electric power connector by providing a novel electric connector adapting structure to overcome the shortcomings of the prior art structure.

Therefore, it is a primary objective of the present invention to provide an electric power connector that connects an adapting cable at a lateral side of the connector, and the connector is also connected to a power output port of an electric power cable of a power supply for achieving the adapting effect, and the connector is further connected to an adapting cable for supplying electric power to a port. The connector includes an insulating body and a plurality of electric power terminals installed in the insulating body, and the invention includes an electric connecting portion disposed at the insulating body and corresponding to a vertical side of an open side of the electric power terminals for connecting the adapting cable, such that the adapting cable supplies electric power with an equivalent electric potential to the port, so as to avoid using excessive cable materials or having a poor cable management for the wiring space.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein:

DETAILED DESCRIPTION OF THE PREFERRED EMBODIMENTS

Figure 1:
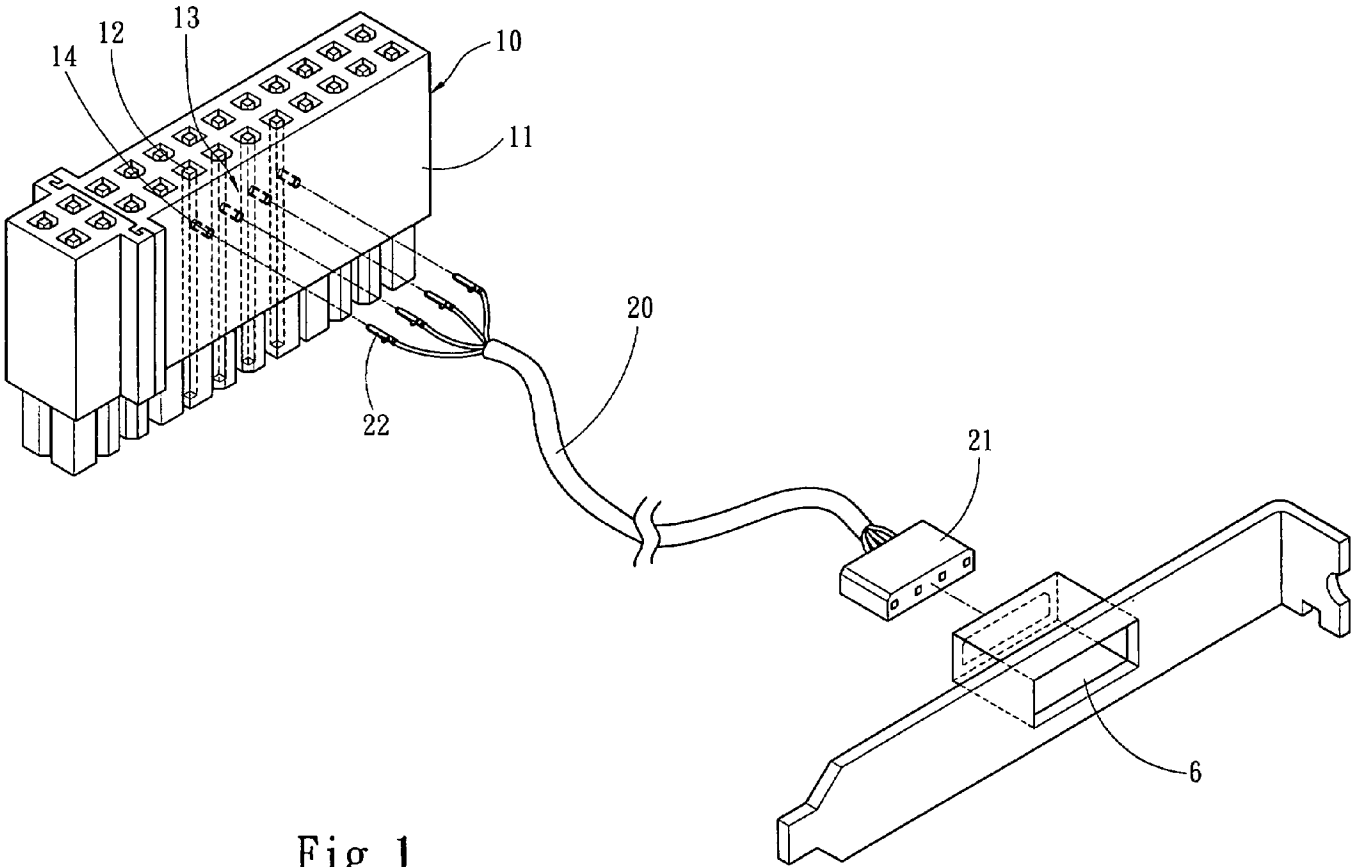
FIG. 1 is a pictorial drawing of the present invention.
Figure 2A:
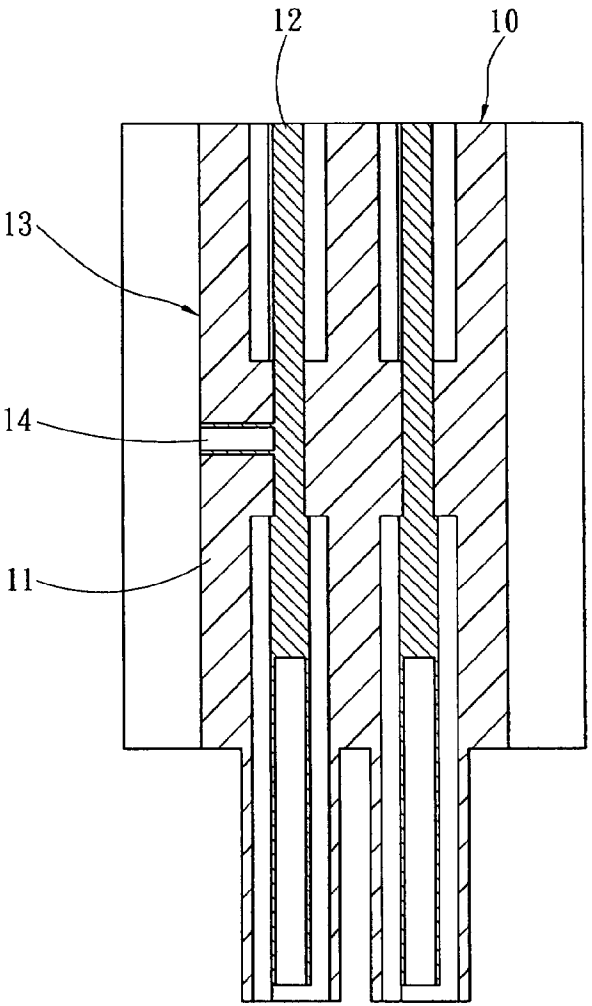
FIG. 2A is a cross-sectional view of the present invention.
Figure 2B:
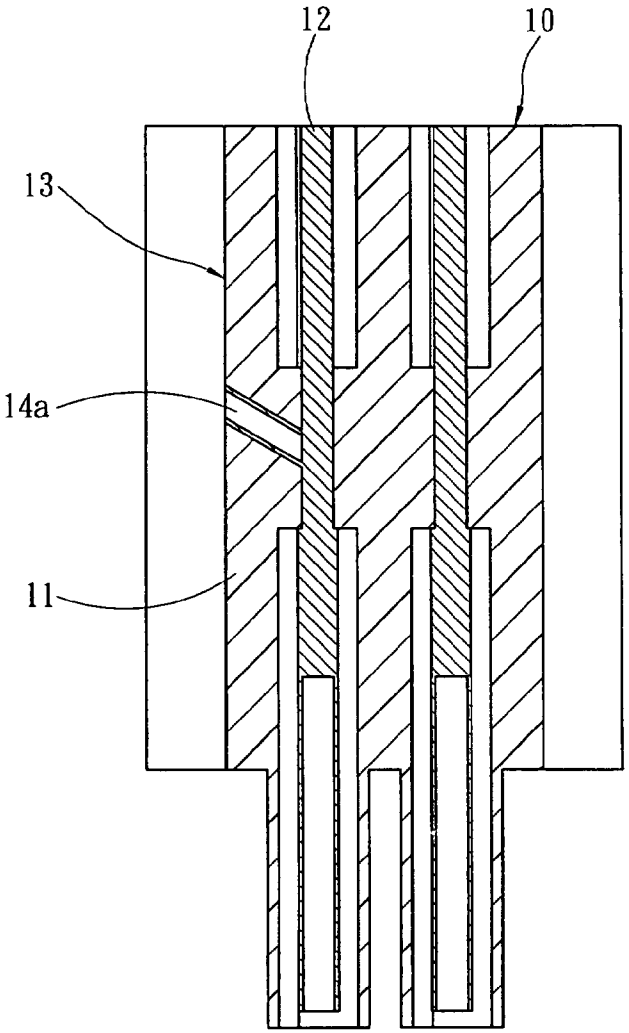
FIGS. 2B and 2C are cross-sectional views of other preferred embodiments of the present invention.
Figure 2C:
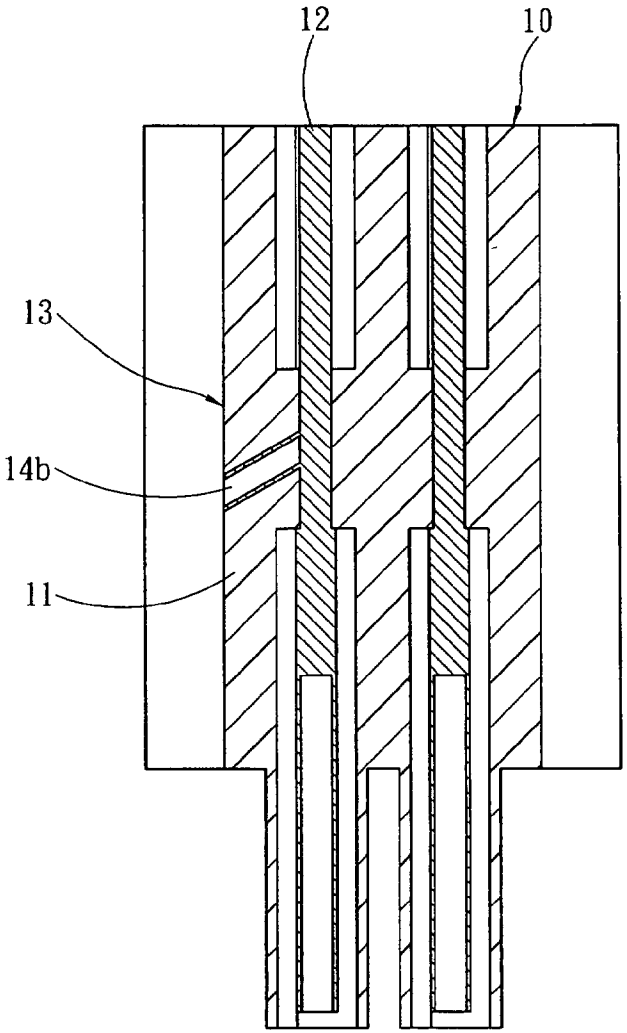
Figure 5:
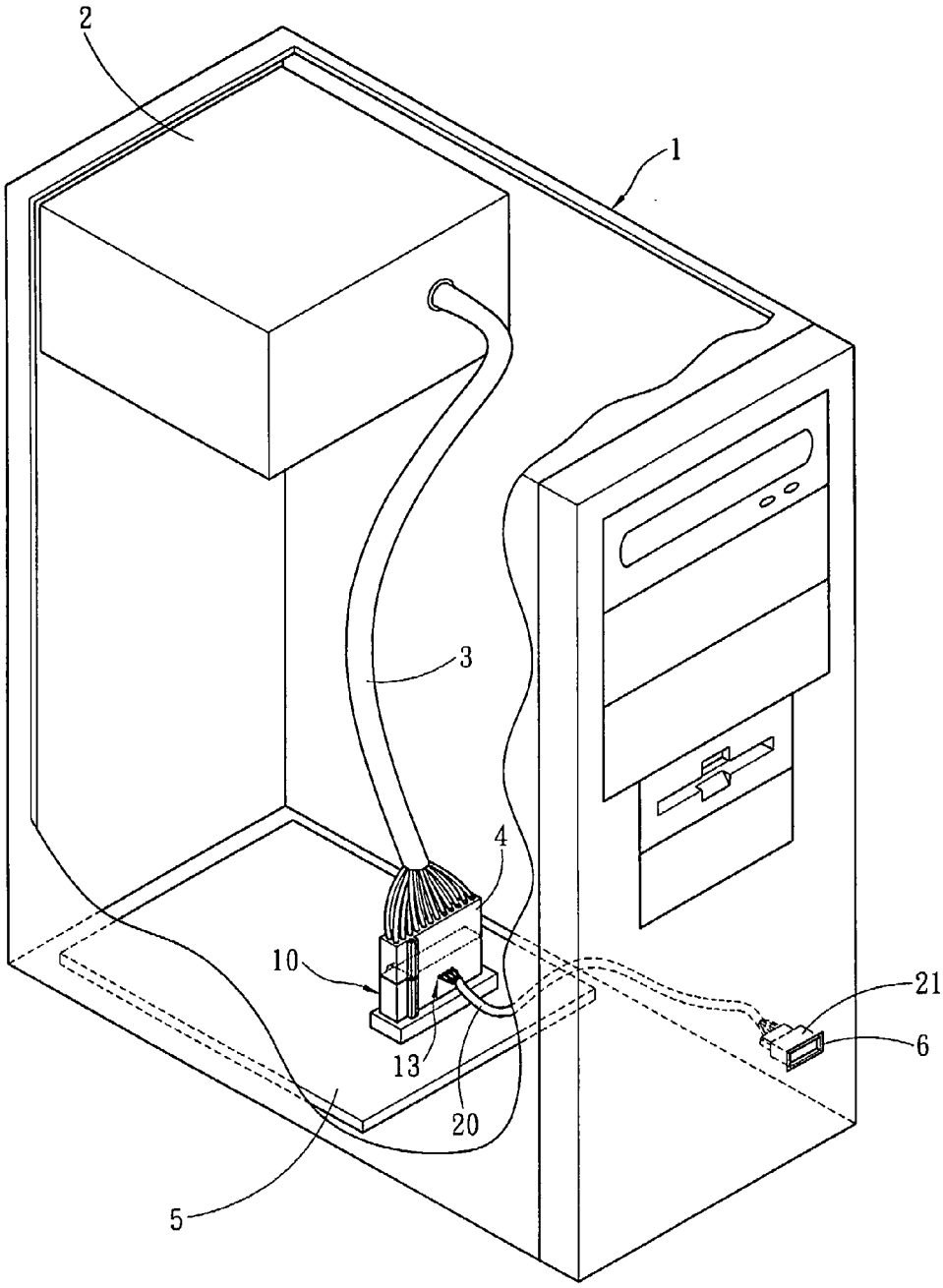
FIG. 5 is a schematic view of an application according to a preferred embodiment of the present invention.

The present invention will now be described in more detail hereinafter with reference to the accompanying drawings as follows:

Referring to FIGS. 1 and 2A for the pictorial drawing and the cross-sectional view of the present invention respectively, the present invention relates to an electric power connector adapting structure, the connector 10 is connected to an electric power cable 3 of a power supply 2 for the electric power transmission of a motherboard 5 (as shown in FIG. 5) and the connector 10 is a 20-pin or 24-pin connector 10, and the connector 10 is connected to an adapting cable 20 for supplying electric power to a port 21, and the connector 10 includes an insulating body 11 and a plurality of electric power terminals 12 installed in the insulating body 11, and the insulating body 11 includes an electric connecting portion 13 electrically coupled to the electric power terminal 12 and corresponding to a vertical side of an open side of the electric power terminal 12, such that the adapting cable 20 supplies electric power with an equivalent electric power to the port 21 by means of the connection of the electric connecting portion 13 and the electric power terminal 12, wherein the electric connecting portion 13 includes a through hole 14 disposed perpendicular to a lateral side of the insulating body 11 as shown in FIG. 2A, and an end of the adapting cable 20 includes an adapting terminal 22 passing through the through hole 14 and perpendicularly connecting to the electric power terminal 12, wherein the electric connecting portion 13 includes a slanting through hole 14*a*, 14*b* with respect to the electric power terminal 12, such that the adapting cable 20 is connected to the electric power terminal 12 with an included angle by the adapting terminal 22 (as shown in FIGS. 2B and 2C).

Figure 3:
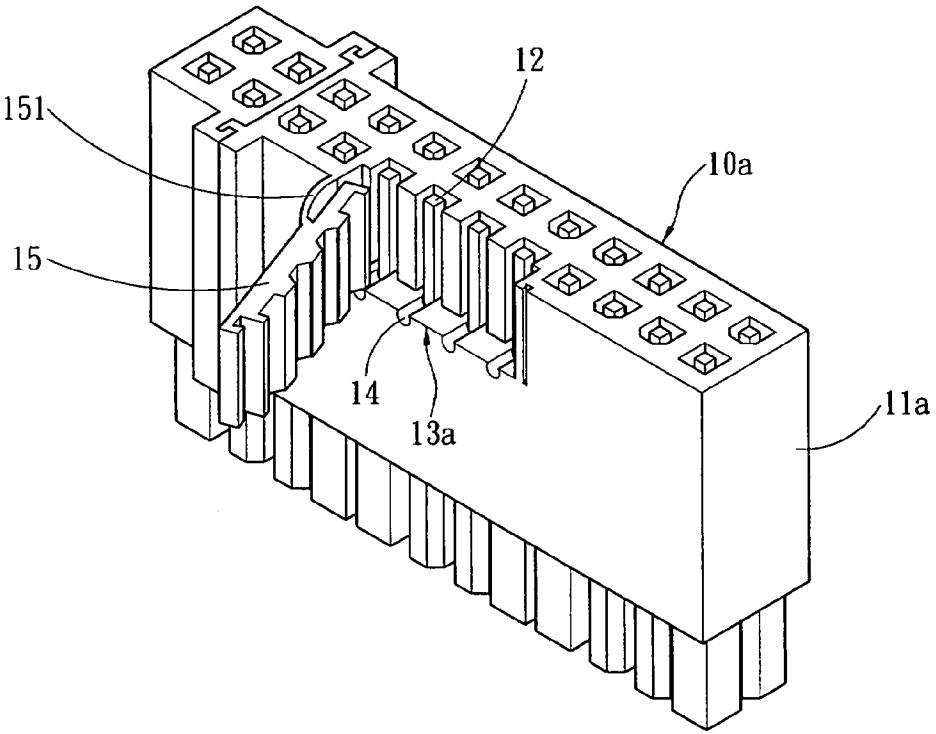
FIG. 3 is a schematic view of a preferred embodiment of the present invention.

Referring to FIG. 3 for the schematic view of a preferred embodiment of the present invention, the insulating body 11*a* includes an electric connecting portion 13*a*, disposed at a lateral side of the insulating body 11*a*, and the electric connecting portion 13*a* includes a clamping portion 15 corresponding to the through hole 14, and the clamping portion 15 produces a rotary path by the connecting portion 151 under the exertion of a force and has an open angle that facilitates its installation to the adapting terminal 22 and a closed angle formed by a positioning relation for compressing the adapting terminal 22. By the clamping portion 15, the connector 10*a* can be connected to an adapting terminal 22 on a transmitting cable 20 easily, and the adapting terminal 22 can be secured and positioned between the connector 10*a* and the clamping portion 15 by a simple and easy installation, and passed through the through hole 14 and electrically coupled to the electric power terminal 12 in the connector 10*a*.

Figure 4:
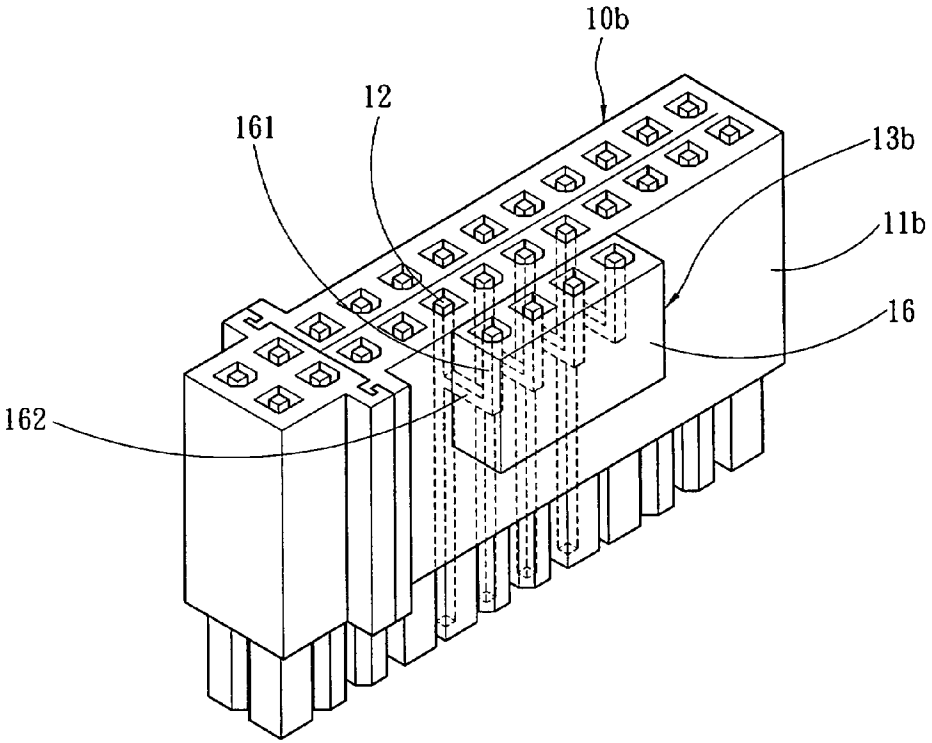
FIG. 4 is a schematic view of another preferred embodiment of the present invention.

Referring to FIG. 4 for the schematic view of another preferred embodiment of the present invention, the connector 10*b* includes an insulating body 11*b* and an electric connecting portion 13*b* disposed on a lateral side of the insulating body 11*b*. The electric connecting portion 13*b* of this embodiment includes an adapting port 16 connected to the adapting cable 20, and the adapting port 16 includes a guiding pin 161 electrically coupled to the electric power terminal 12 and disposed parallel to the electric power terminal 12, and a coupling section 162 is extended to connect the electric power terminal 12, so that the adapting cable 20 can be connected to the adapting port 16, and the adapting cable 20 is connected to the electric power terminal 12 by the electric connecting portion 13*b* and adapted to supply electric power with an equivalent electric potential to the port 21.

Referring to FIG. 5 for the schematic view of an application of the present invention, a computer host 1 generally has a power supply 2 installed therein, and an electric power cable 3 of the power supply 2 comes with a power output port 4 for connecting and supplying electric power to the motherboard 5. The connector 10 of this preferred embodiment is an adapter having an end connected to the power output port 4 and the other end connected to the motherboard 5, and the electric connecting portion 13 of the connector 10 is connected to an adapting cable 20 disposed at a lateral side of the connector 10, such that the adapting cable 20 supplies electric power with an equivalent electric potential to the port 21 by means of the connection of the electric connecting portion 13 and the electric power terminal 12. The connecting method of the connector 10 in this preferred embodiment can satisfy the specification of a power supply implemented in various different computers, so as to adapt and output electric power to the port 6 on the surface of the computer host 1 for users' operations. In addition to supplying electric power to the motherboard 5 from the 20-pin or 24-pin connector 10 when the computer host 1 is turned on, the connector 10 is adapted additionally for the use of electric power for other specifications (such as the USB specification), further, the connector 10 is connected to an adapting cable 20 for the electric power source for lighting up a small lamp or charging the battery of a mobile phone when the computer host 1 is turned off, and thus fully utilizing the electric power supplied from the electric power terminal 12 when the computer is turned off. The present invention can save electric power to meet the requirements of environmental protection, and the diversified functions of the connector 10 provide more convenience to users.

In the description above, the present invention includes an electric connecting portion 13 electrically coupled to the electric power terminal 12 and disposed on the insulating body 11 corresponding to the vertical side of an open side of the electric power terminal 12, such that the adapting cable 20 supplies electric power with an equivalent electric potential to the port 21 by means of the connection of the electric connecting portion 13 and the electric power terminal 12. When the computer host 1 is turned on, the port 6 can be connected to a 20-pin or a 24-pin connector 10 to adapt the port 6 for the use of power supply for other specifications (such as the USB specification) or when the computer host 1 is turned off, the port 6 can be connected to the port 21 of the adapting cable 20 for supplying electric power to the port 6 for lighting up a small lamp or charging the battery of a mobile phone, and the diversified functions of the connector 10 provide more convenience to users. The present invention connects the adapting cable 20 to a lateral side of the connector 10 for facilitating an easy installation and effectively avoiding a poor cable management of a motherboard 5 that uses excessive cable materials, and such technology has not been developed or used in the same technical area of the present invention.

While the invention has been described by means of specific embodiments, numerous modifications and variations could be made thereto by those skilled in the art without departing from the scope and spirit of the invention set forth in the claims.

What is claimed is:

1. An electric power connector adapting structure, comprising:

an insulating body with a plurality of electric power terminals installed therein, and a connector being adapted to an adapting cable for supplying electric power to a port, wherein said insulating body includes an electric connecting portion electrically coupled to said electric power terminal and corresponds to a vertical side of an open side of said electric power terminal, such that said adapting cable is coupled to said electric power terminal by said electric connecting portion and adapted to supply electric power with an equivalent electric potential to said port, wherein said electric connecting portion includes a through hole corresponding to said electric power terminal, and an end of said adapting cable includes an adapting terminal passing through said through hole and is coupled to said electric power terminal with an included angle, and wherein said insulating body includes a clamping portion corresponding to said through hole, which produces a rotary path at its connecting position under the exertion of a force and produces an open angle for facilitating an easy installation of said adapting terminal and a closed angle for pressing said adapting terminal to define a positioning relation.

2. The electric power connector adapting structure of claim 1, wherein said connector is installed to said electric power cable of a power supply for outputting electric power.

3. The electric power connector adapting structure of claim 1, wherein said connector is connected to a power output port that is coupled to said electric power cable of a power supply for outputting electric power.

4. The electric power connector adapting structure of claim 1, wherein said connector is provided for connecting a computer motherboard and includes a 24-pin connector or a 20-pin connector.

5. The electric power connector adapting structure of claim 1, wherein said electric connecting portion includes an adapting port disposed on said insulating body for connecting said adapting cable, and said adapting port includes a guiding pin disposed therein and electrically coupled to said electric power terminal.

6. The electric power connector adapting structure of claim 5, wherein said guiding pin includes a coupling section, and said coupling section is coupled to said electric power terminal with an included angle.

* * * * *